US007109949B2

(12) United States Patent
Sekiya et al.

(10) Patent No.: US 7,109,949 B2
(45) Date of Patent: Sep. 19, 2006

(54) SYSTEM FOR DISPLAYING IMAGE, METHOD FOR DISPLAYING IMAGE AND PROGRAM THEREOF

(75) Inventors: Kazuo Sekiya, Tokyo-to (JP); Hajime Nakamura, Yokohama (JP)

(73) Assignee: International Business Machines Corporation, Armonk, NY (US)

( * ) Notice: Subject to any disclaimer, the term of this patent is extended or adjusted under 35 U.S.C. 154(b) by 443 days.

(21) Appl. No.: 10/440,094

(22) Filed: May 19, 2003

(65) Prior Publication Data

US 2004/0233157 A1 Nov. 25, 2004

(30) Foreign Application Priority Data

May 20, 2002 (JP) ..... 2002-145309

(51) Int. Cl.
*G09G 3/20* (2006.01)
*G09G 5/50* (2006.01)

(52) U.S. Cl. ..... 345/58; 345/87

(58) Field of Classification Search ..... 345/87, 345/58, 89, 98, 99, 204
See application file for complete search history.

(56) References Cited

U.S. PATENT DOCUMENTS 6,340,961 B1 * 1/2002 Tanaka et al. ..... 345/63
6,556,180 B1 * 4/2003 Furuhashi et al. ..... 345/87

FOREIGN PATENT DOCUMENTS

| | | |
|---|---|---|
| JP | 01-215185 | 8/1989 |
| JP | 02-153689 | 6/1990 |
| JP | 03-096993 | 4/1991 |
| JP | 03-212615 | 9/1991 |
| JP | 03-212681 | 9/1991 |
| JP | 09-330057 | 12/1997 |
| JP | 10-133623 | 5/1998 |
| JP | 11-249617 | 3/1999 |
| JP | 2000-002841 | 1/2000 |
| JP | 2000-020023 | 2/2000 |
| JP | 2000-039864 | 2/2000 |
| JP | 2000-330501 | 11/2000 |
| JP | 2001-083926 | 3/2001 |
| JP | 2003-283876 | 3/2003 |

* cited by examiner

*Primary Examiner*—Dennis-Doon Chow
(74) *Attorney, Agent, or Firm*—E. Dwayne Nelson, Esq.; McGinn IP Law Group, PLLC

(57) ABSTRACT

A system (method and program for storing the method) for displaying an image, includes a motion object detector for detecting a motion object in image information inputted to the system, a recognizing device for recognizing a moving state in the motion object detected by the motion object detector, a modification information adder for adding modification information to the image information in regard to the motion object detected by the motion object detector based on the moving state recognized by the recognizing device, and a display device for displaying the image information having been added with the modification information by the modification information adder.

21 Claims, 9 Drawing Sheets

SYSTEM FOR DISPLAYING IMAGE, METHOD FOR DISPLAYING IMAGE AND PROGRAM THEREOF

BACKGROUND OF THE INVENTION

1. Field of the Invention

The present invention generally relates to an image display system, an image display method and a program, which are for displaying an image, and more specifically, to an image display system, an image display method and a program that improve quality of an image moving on a display.

2. Description of the Related Art

In recent years, among display devices, a liquid crystal display (LCD) provided with thin film transistors (TFT) has continued to develop greatly from viewpoints of its reduction in weight, thinness, portability, low power consumption and so on. Such an LCD is a display utilizing a property of liquid crystals, in which a molecular alignment is changed by applying a predetermined voltage thereto.

Moreover, an organic light emitting diode (OLED) (also called "an organic EL") has attracted attention as a next-generation display device. The OLED is a device for emitting light by flowing a direct current through a fluorescent organic compound excited by applying an electric field thereto. The OLED is thin, can achieve a wide viewing angle and be used for a wide variety of applications.

For example, though an LCD for use in a PC has been mainly used for displaying a still image heretofore, the LCD has become widely used in place of a cathode ray tube (CRT) such as for displaying a motion picture as a graphics system and displaying a video image as a monitor and the like. In this connection, the technology of displaying a motion picture on the LCD has attracted attention increasingly. Moreover, with the OLED, the necessity of improving motion picture quality is high.

In the case of displaying a motion picture in such a manner, in the display devices other than an impulse-type display such as the CRT, several defects occur with regard to an object in motion due to an effect of a so-called "light-stimulus integration" (properties of an afterglow reflected on a human retina when following a motion picture).

Such defects include a blur of the front edge, a tailing of the rear edge, a lowering of the brightness, and a delay of the perceived position on the front edge or a center position.

Here, the LCD is a hold-type apparatus in which light is continuous for the entire period of a frame, and in terms of the motion picture quality, the LCD cannot follow the CRT as it is.

For example, in a TFT-LCD of a current twisted nematic (TN) mode, the response time of ON/OFF is approximately one refresh cycle (16.7 ms at a 60 Hz refresh rate). Such a response time is much slower than the response time of the CRT, which is almost zero (0).

In this connection, there is a so-called "overdrive technology" as one of the improvements in the response time in the LCD. In order to improve the response characteristics of the LCD to a step input, this overdrive technology applies a higher voltage than a target voltage for the step input in the first frame where the input is changed, and accelerates transition of the brightness. The use of this overdrive technology reduces the response time to one frame or less, and brings the display quality of the LCD close to the quality of a so-called "complete-hold-type" (of which response time is close to zero). The above-described OLED corresponds to this complete-hold-type display.

FIGS. 9(*a*) and 9(*b*) are diagrams for explaining the light-stimulus integration in the complete-hold-type display.

FIG. 9(*a*) shows a state where the object 301 having the brightness V and the width W (pixels) moves at the moving speed S (S pixels per frame) in a screen coordinate system. In this case, the moving speed of the sight that follows the object is also S.

In FIG. 9(*a*), the axis of ordinates represents times and shows a state where the object 301 moves in the left-to-right direction to the time 0 taking a time for two frames (here, 33.3 ms) and further moves for one frame (16.7 ms) before the start of the next frame. In the example shown in FIGS. 9(*a*) and 9(*b*), the moving speed S is larger than the width W. Specifically, the relation $W/S \leqq 1$ is established.

FIG. 9(*b*) shows a light-stimulus integration in this case, in which the axis of ordinates represents brightness and the axis of abscissas represents a retinal coordinate system. When the time is zero (0), a brightness of pixels (S−W) among the entire pixels (S+W) is represented as: $V \cdot \{W/S\}$ with respect to the original brightness V. The brightness gradually increases before the pixels (S+W) and gradually decreases thereafter. The front edge from which the brightness gradually increases becomes blurred, and the rear edge to which the brightness gradually decreases becomes tailed (e.g., tails off). Moreover, there occurs a center delay of S/2 for a position in the screen coordinate system at the time of starting the next frame.

Specifically, even if the complete-hold-type is used, the object with the width W expands to S+W in the retinal coordinate system when moving at the moving speed S. Moreover, there occur the lowering of the brightness, the delay of the perceived position, the blur of the front edge, and the tailing of the rear edge.

Moreover, in order to bring the display device such as an LCD and an OLED close to the impulse type such as the CRT from the complete-hold-type display, a so-called "blanking system" is suitably used, in which light is emitted intermittently for each frame, and a light emitting time is reduced.

However, for example with regard to the OLED, the light emission efficiency is low, and the brightness is lowered if the blanking is employed therefor, thereby lowering the contrast.

SUMMARY OF THE INVENTION

In view of the foregoing and other problems, drawbacks, and disadvantages of the conventional methods and structures, a feature of the present invention is to provide a method and structure for improving the quality of a motion picture displayed on a so-called "hold-type display".

Another purpose of the present invention is to suppress the blur of the front edge, the tailing of the rear edge, the lowering of the brightness, and the perception of delay at the front edge or center position of an object, which are caused by properties of an afterglow reflected on a human retina when tracking a motion image such as a motion picture (hereinafter, sometimes abbreviated as "a motion picture"). Such suppression is carried out by modifying the brightness V of the object by use of a wave with a wavelength S in the case where the moving speed of the object is S when the motion picture is displayed particularly on the hold-type display.

In a first exemplary aspect of the present invention, an image display system includes an image information inputting means for receiving image information, motion object detecting means for detecting a motion object of the received image information, recognizing means for recognizing a moving state in the detected motion object, modification information adding means for adding modification information to the image information in regards to the detected motion object based on the recognized moving state, and providing means for providing the image information added with the modification information to a display device.

Here, in the exemplary image display system, the recognizing means preferably recognizes a moving speed S as the number of moving pixels of the motion object between consecutive frames, and the modification information adding means adds modification information including a wave with a wavelength S such as, for example, a sine wave therewith, to the image information based on the moving speed S recognized by the recognizing means.

Moreover, in the exemplary image display system, preferably the recognizing means recognizes the moving speed S of the motion object, and the modification information adding means changes the modification information added to the image information in accordance with a magnitude relationship between the recognized moving speed S and the width W in a moving direction of the motion object.

Furthermore, in the exemplary image display system, preferably an object transforming means is provided for transforming the motion object detected by the motion object detecting means.

Preferably, the modification information adding means adds the modification information to the image information in regards to the transformed motion object.

In a second exemplary aspect of the present invention, an image display method is provided for displaying an image in motion on a hold-type display device.

The exemplary method includes receiving image information to be displayed on the display device, detecting a motion object in the received image information, creating modification information modifying the detected motion object, adding the created modification information to the image information in regard to the motion object, and outputting the image information added with the modification information.

In the exemplary image display method, the method preferably further includes recognizing movement information in regard to the detected motion object. Preferably, such a movement information recognizing step includes creating modification information which creates the modification information based on the recognized movement information. This created modification information is a wave with a wavelength S, for example, when the moving speed of the object is S (S pixels per frame).

From another viewpoint, an exemplary image display method according to the present invention, preferably includes receiving image information to be displayed on the display device, recognizing the moving speed S as the number of moving pixels of the motion object between consecutive frames, the motion object existing in the received image information, recognizing the width W as the number of pixels along a moving direction of the motion object, and adding modification information to the motion object based on the recognized moving speed S and width W.

Moreover, the image display method preferably further includes creating a transformed motion object by transforming the motion object, which can be characterized in that the step of adding modification information adds the modification information to the transformed motion object created.

More specifically, in the exemplary image display method, preferably the creating of a transformed motion object creates the transformed motion object by expanding and contracting the width W to an integral multiple of the moving speed S when the width W is close to the integral multiple of the moving speed S, and the adding of the modification information modifies the transformed motion object created by use of modification information composed of a wave with a wavelength S.

Furthermore, in the exemplary image display method, preferably the adding of modification information modifies the motion object by use of a wave with a wavelength S, the wave slowly attenuating from both of the front and rear edges of the motion object toward the inside thereof, when the width W is sufficiently larger than the moving speed S.

It is noted that these programs can be grasped as a program for allowing a computer for driving a hold-type display device to execute the following functions.

This program allows the computer to execute a function for detecting a motion object in received image information, a function for creating modification information modified to the detected motion object, a function for adding the created modification information to the image information in regards to the motion object, and a function for outputting the image information added with the motion object to the display device.

Here, preferably, the program further includes a function for allowing the computer to recognize the moving speed of the motion object such that the created modification information includes information varied depending on the recognized moving speed, so that an image with a blur or the like can be improved.

Moreover, the program can be characterized in that the recognized moving speed preferably includes the number of pixels S between consecutive frames, and the created modification information preferably includes a sine wave with a wavelength S.

From another viewpoint, a further exemplary program according to the present invention allows a computer to realize a function for receiving image information to be displayed on a display device, a function for recognizing the moving speed S as the number of moving pixels of the motion object between consecutive frames, the motion object existing in the received image information, a function for recognizing the width W of the object as the number of pixels along the moving direction of the motion object, and a function for adding modification information to the motion object based on the recognized moving speed S and width W.

Here, in this further exemplary program, preferably the function for adding modification information expands and contracts the width W to a width adapted to an integral multiple of the moving speed S when the width W is close to the integral multiple of the moving speed S, and modifies the motion object by use of a wave with a wavelength S.

The present disclosure relates to subject matter contained in Japanese Patent Application No. 2002-145309, filed on May 20, 2002, which is expressly incorporated herein by reference in its entirety.

BRIEF DESCRIPTION OF THE DRAWINGS

The foregoing and other purposes, aspects and advantages will be better understood from the following detailed description of an exemplary embodiment of the invention with reference to the drawings, in which:

FIG. 3(*d*) shows a light-stimulus integration without the modification;

FIG. 3(*e*) shows a light-stimulus integration when performing 50% blanking even without the modification;

DETAILED DESCRIPTION OF EXEMPLARY EMBODIMENTS OF THE INVENTION

Figure 1:
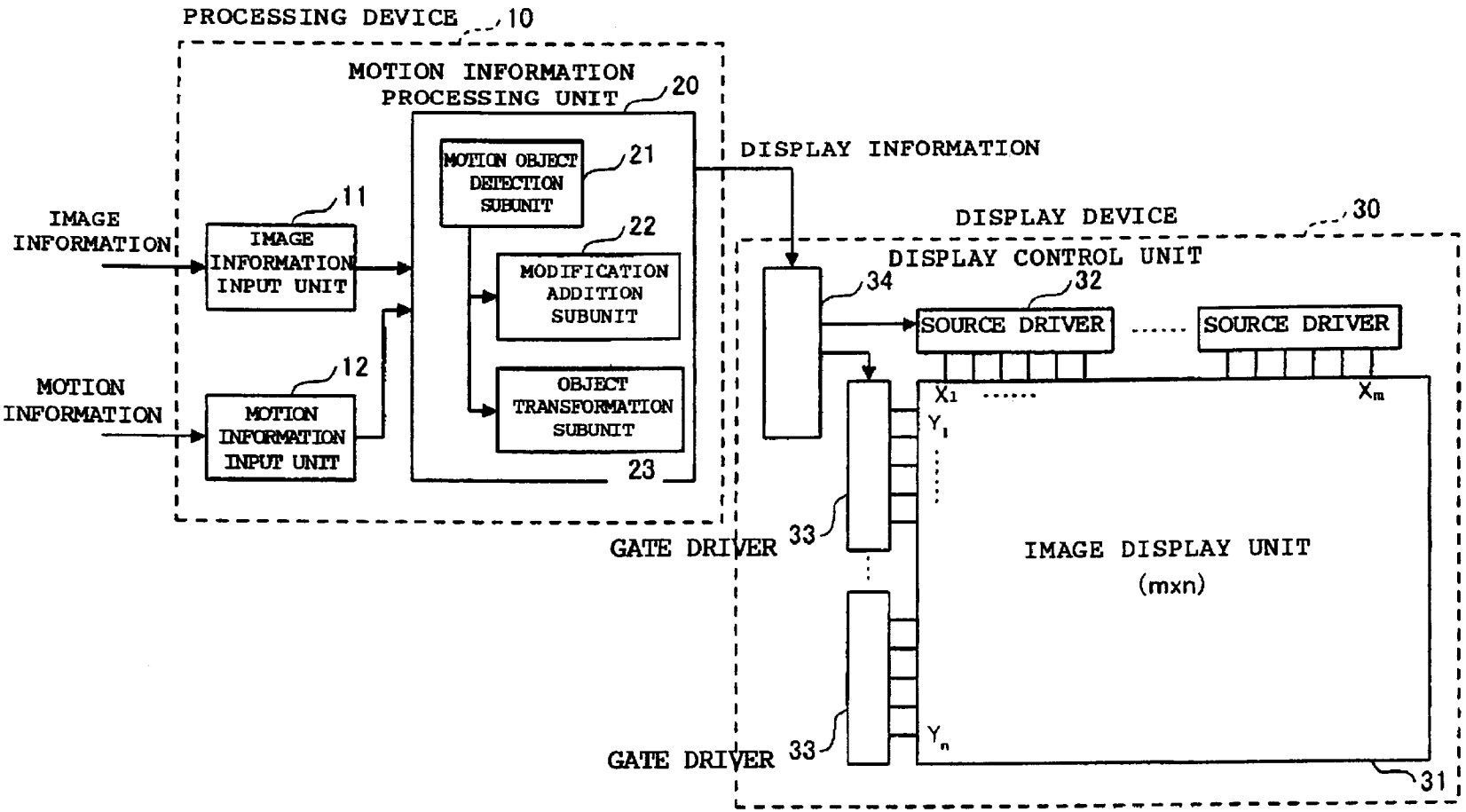
FIG. 1 is a diagram showing an entire configuration of an image display system to which an exemplary embodiment according to the present invention is applied.

Referring now to the drawings, and more particularly to FIGS. 1–8(*b*), there are shown exemplary embodiments of the method and structures according to the present invention.

Exemplary Embodiment

The present invention will be described in detail based on an embodiment shown in the accompanying drawings.

FIG. 1 is a diagram showing the entire configuration of an image display system to which this exemplary embodiment is applied.

The image display system shown in FIG. 1 includes the processing device 10 for processing image information obtained from a host side and outputting display information, and the display device 30 for actually displaying an image based on the image information obtained from the processing device 10.

Here, the "system" means a logical aggregation of a plurality of devices (functions), which has no relation to whether the devices (functions) of the constituent components exist in the same case or not. Accordingly, for example, similarly to a notebook-type personal computer ("notebook PC"), an aggregate of the constituent components configuring the image display system may be made into one object to be dealt with in some cases. In other cases, only the display device 30 may be singly dealt with as a separate body.

Moreover, the processing device 10 is a computer connected to the display device 30, and is generally composed by including pieces of software allowing the computer to execute the respective functions. Note that it is also possible to configure the image display method described in this exemplary embodiment with hardware.

The display device 30 includes the image display unit 31 as a dot matrix-type display, for example, where m×n pixels are arranged (of a m×n arrangement), the source drivers 32 for supplying data signals to data lines X1 to Xm, the gate drivers 33 for supplying select signals (address signals) to scan lines Y1 to Yn, and the display control unit 34 for outputting control signals to be supplied to the driver circuits at a necessary time based on display information (video signals) obtained from the processing device 10.

As the image display unit 31, for example, an organic light emitting diode (OLED) display and a liquid crystal display (LCD) of the active matrix type, which use amorphous silicon (a-Si) TFTs, can be provided.

Moreover, as the LCD, a display in which an absolute precision and a response speed are sufficiently high can be used, such as, for example, a fast response type liquid crystal panel including an optically compensated birefringence (OCB) type.

The processing device 10 includes the image information input unit 11 for receiving image information from the host side, the motion information input unit 12 for receiving motion information outputted separately in the case where the data is of MPEG4 or CAD, and the image information processing unit 20 for executing a variety of processing for the image information received by the image information input unit 11 and outputting the image information to the display device 30.

The image information processing unit 20 includes the motion object detection sub-unit 21 for detecting a continuously moving object from the image information, the modification addition sub-unit 22 for modifying the brightness of the continuously moving object, and the object transformation sub-unit 23 for transforming the brightness form of the continuously moving object and generating a transformed motion object.

Next, reduction processing for the blur (tailing) and the like will be described, which is executed in the image display system to which this exemplary embodiment is applied.

Here, for simplifying the description, it is assumed that, for an image to be dealt with, the background thereof is one solid color and that the object moves on the image display unit 31 at a certain speed (S pixels per frame). When the light-stimulus integration is traced, the brightness on the trace becomes a periodic function under this premise, and it will be satisfactory if only one frame amount of the light-stimulus integration may be considered. Here, the light-stimulus integration can be said to be properties of an afterglow reflected on the human retina when tracking a motion image (motion picture). Moreover, it is assumed that the object has a width for W pixels in the traveling direction and a brightness V and is painted solidly and that the brightness change of the boundary (edge) is made vertically. The above assumption facilitates calculations, and conditions for the solid painting and edging can be further eased.

Here, in this exemplary embodiment, results of the light-stimulus integration in the complete hold-type display subjected to 50% blanking can be set as target quality. As determination items of the target quality, steepness of perceptual boundaries (front and rear edges) and a half value of the reached brightness (half value of the maximum brightness) are considered.

Furthermore, how wide the width of the maximum brightness and the width of the half brightness expand is set are determination items. Moreover, with regard to the width of a stage (width giving brightness of which integration is not zero), the stage will be regarded as a background if the integrated brightness is sufficiently small even if the stage is wide, and the width of the stage is not set as an improvement item.

Furthermore, with regard to the maximum brightness, the contrast reduction caused by the lowering of the maximum brightness of the object is improved if the moving speed is fast. Still further, with regard to the delay of the object center, not the center of gravity but the point of the maximum brightness (center when the brightness is flat) is taken in consideration of naturalness for the observer's perception. It is noted that the delay of the center position in the complete-hold-type display can be solved subordinately by advancing the front edge.

Figure 2:
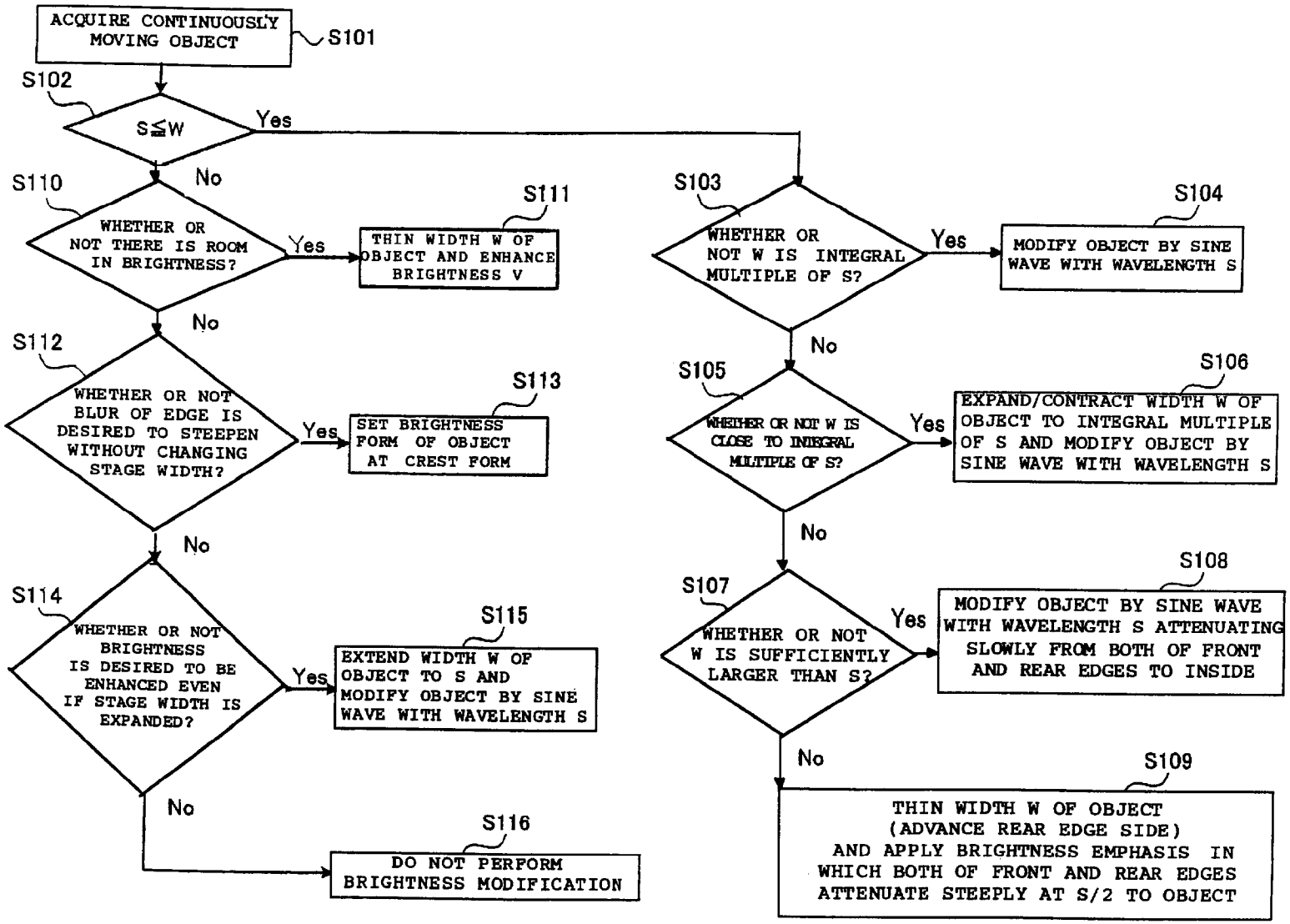
FIG. 2 is a flowchart showing a flow of processing executed in a processing device.

FIG. 2 is a flowchart showing a flow of processing executed in the processing device 10 shown in FIG. 1.

In the motion object detection sub-unit 21, first, a continuously moving object is acquired (Step 101).

Next, as described above, the moving speed (the number of moving pixels between consecutive frames) of the continuously moving object (brightness V) is defined as S, and the width (the number of pixels) of the object, which is measured along a line parallel to the moving direction, is defined as W. Then, it is determined whether $S \leqq W$ is established or not in this case (Step 102).

Specifically, it is determined whether the speed is slower or not as compared with the width W of the object. If the speed is slower (e.g., a "YES" in step 102), then the processing switches to that of Step 103 and after.

If the speed is faster (e.g., a "NO" in step 102), then the processing switches to that of Step 110 and after. It is noted that the processing is executed in the modification addition sub-unit 22 and the object transformation sub-unit 23.

If the speed is slower (e.g., a "YES" in step 102), then it is first determined whether or not the width W of the object is an integral multiple of the moving speed S (Step 103).

If the width is an integral multiple (e.g., a "YES" in step 103), then the object is modified by a sine wave as a wave with the wavelength S (Step 104).

If the width is not the integral multiple (e.g., a "NO" in step 103), then it is determined whether or not the width W of the object is close (e.g., predeterminedly close) to the integral multiple of the moving speed S (Step 105). If the width is close to the integral multiple (e.g., a "YES" in step 105), then the width W of the object is expanded/contracted to the integral multiple of the moving speed S, and the object is modified by a sine wave with a wavelength S similarly to Step 104 (Step 106).

If the width is not close to the integral multiple (e.g., a "NO" in step 105), then it is determined whether or not the width W of the object is sufficiently larger than the moving speed S (Step 107).

If the width is sufficiently larger (e.g., a "YES" in step 107), then the object is modified by a sine wave with a wavelength S, which attenuates slowly from both of the front and rear edges of the object to the inside thereof (Step 108).

If the width W of the object is not sufficiently larger (e.g., a "NO" in step 107), then it is thinned to advance the rear edge side, and thus a brightness emphasis in which both of the front and rear edges attenuate steeply at S/2 is applied to the object (Step 109).

On the other hand, if the speed is determined to be faster in Step 102 (e.g., a "NO" in step 102), it is first determined whether there is room in the brightness or not (Step 110).

If there is room (e.g., a "YES" in step 110), the width W of the object is thinned to enhance the brightness V (Step 111). Specifically, the existence of the "room" in Step 110 can be said to have room in the gray scale suitable for the amount to thin the width W of the object and to enhance the brightness V.

If there is no room for the brightness (e.g., a "NO" in step 110), then it is determined whether the blur of the edge is desired to steepen (increase) without changing the stage width (width W of the object) (Step 112). An exemplary aspect to which this determination can be applied, may include a case where a setting is made so that the blurred region is steepened even if the brightness is sacrificed to some extent (e.g., such as displaying a motion of an airplane, car, ship or the like).

If "YES" in Step 112, then the brightness form of the object is set at a crest form (Step 113).

If "NO" in Step 112, then it is determined whether or not the brightness is desired to be enhanced even if the stage width (width W of the object) is expanded (Step 114). An exemplary aspect to which this determination can be applied, may include when the object is a motion that cannot be captured in the case of lowering the brightness (e.g., such as a motion of a ball for baseball or football).

If "YES" in Step 114, then the width W of the object is extended to the moving speed S, and the object is modified by a sine wave with the wavelength S (Step 115).

If "NO" in Step 114, then the brightness modification is not carried out (Step 116).

As described above, the processing of brightness modification (i.e., processing of overlaying brightness modulations) is carried out in accordance with conditions. For the moving speed S, the modulation transfer function (MTF: Fourier component's strength of a spatial frequency) of the wave with the wavelength s (and a high frequency thereof) becomes zero by the light-stimulus integration.

Therefore, the brightness V of the solidly painted object is modified by the wave with the wavelength S (sine wave is satisfactory), the front edge (and the rear edge, if possible) as a result of the light-stimulus integration is advanced and steepened. The MTF is still zero even if the processing is performed in such a manner. Therefore, this wave is not perceived as a wave. Accordingly, the solidly painted portion can be displayed as it is with the brightness V.

It is noted that the compensation for the position delay is performed in accordance with an amount of delay displaced by the modification after the modification processing in this flowchart. This "compensation for the position delay" is performed by displaying a moving object on a position advanced slightly from the original position so that the front edge of the light-stimulus integration result comes to the same position as in the case of the impulse type.

If the above-described "overlay of the brightness modulations" is executed, then the delay amount in that case is used. If not executed (e.g., if the moving speed is slow in the complete-hold-type display), then the moving object is advanced by S/2 pixels. As a result, both of the front edge and the center are compensated. Moreover, for example, if the moving speed is faster in the complete-hold-type, then the moving object is advanced by W/2 pixels. Thus, the front edge can be compensated.

Next, the image display processing described with reference to FIG. 2 will be further described in detail.

Figure 3:
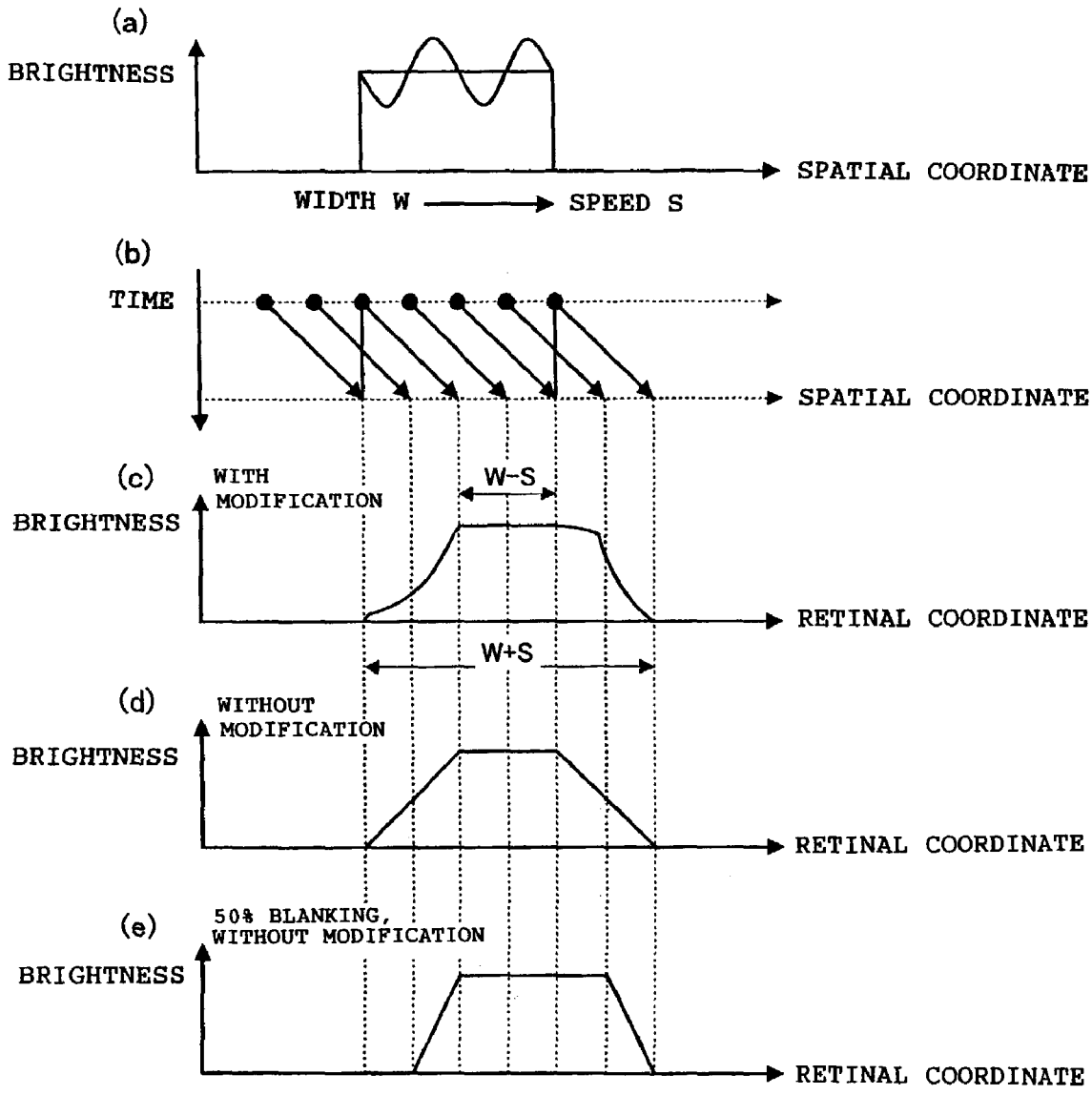
FIGS. 3(*a*) to 3(*c*) are diagrams for explaining modification when the moving speed S is slower (S≦W) and the width W of an object is an integral multiple of the moving speed S.

FIGS. 3(*a*) to 3(*c*) are diagrams for explaining the modification when the moving speed S is slower ($S \leqq W$) and the width W of the object is an integral multiple of the moving speed S.

First, FIG. 3(*a*) shows a state where the object with the width W is modified by a sine wave with the wavelength S, which is shown in Step 104 of FIG. 2, when the object moves on the image display unit 31 at the speed S. Here, in the case of: W=2S, a sine wave with the wavelength S is modified into the brightness of the object. In this case, a waveform, in which a crest starts from the right edge of the object, is used for the sine wave since the object moves to the right side.

FIG. 3(*b*) shows a state where retinal coordinates of an eye tracking an object held on screen coordinates (spatial coordinates) for one frame move thereon with the elapse of time.

Moreover, FIG. 3(*c*) shows a light-stimulus integration in the case of the modification by a sine wave as shown in FIG. 3(*a*).

On the other hand, FIG. 3(*d*) shows a light-stimulus integration without the modification as described above, and FIG. 3(*e*) shows a light-stimulus integration when performing 50% blanking thereof even without the modification. This light-stimulus integration when performing the 50% blanking is set as a target quality.

When a sine wave with a wavelength S is superposed on the solidly painted object with the brightness V, brightness of the object modified by the brightness modification is represented as in the following equation 1.

$$V'(x)=V+a\cdot\sin(2\pi\cdot x/S) \qquad \text{Equation 1:}$$

This light-stimulus integration result in the blurred region width S as a blur on the front edge side is represented as in the following equation 2.

$$v(x)=V\cdot x/S+a/2\pi\cdot a/2\pi\cdot\cos(2\pi\cdot x/S) \qquad \text{Equation 2:}$$

The intermediate portion is flat at the maximum brightness in the region width W−S, and is represented as in the following equation 3.

$$v(x)=V \qquad \text{Equation 3:}$$

The blur in the blurred region width S on the rear edge side is represented as in the following equation 4.

$$v(x)=V\cdot(1-x/S)-a/2\pi+a/2\pi\cdot\cos(2\pi\cdot x/S) \qquad \text{Equation 4:}$$

When "a" is maximized in a condition where a ghost image does not occur in the blurred region, a=v is almost established.

In such a case, in the front and rear edge positions where the brightness becomes half of the maximum, the relation in the blurred region S is represented as x/S @ 0.3 and a gradient there becomes 1.6 or more, of which improvements are understood as compared with the value: x/S=0.5, and the gradient equal to 1 in the case without modification (FIG. 3(*d*)). Incidentally, such a value and gradient in the complete-hold-type display with the 50% blanking, which have been taken as targets and are shown in FIG. 3(*e*), are: x/S=0.25; and the gradient equal to 2.

For the width of the flat portion and the width of the stage, no change occurs from the case without modification. However, the brightness changes in the blurred regions become like a logistic curve, and therefore, the effective flat portion is thickened from W−S to be brought close to W. Moreover, on the outside of the half value points, the brightness falls steeply close to the brightness of the background. Therefore, the width of the effective stage is also thinned from W+S to be brought close to W.

When the width W is not accurately a multiple of the moving speed S but close thereto, no serious problem occurs even if the width W itself is somewhat expanded/contracted to the multiple of the moving speed S in the case of the modification as shown in Step 106 of FIG. 2.

Moreover, the phase of the rear edge becomes opposed (opposite phase) when the relation: W=(m+½)·S (half-integral multiple) is established. Therefore, the relation at the rear edge position becomes as: x/S@ 0.7 in the case of: a=V, resulting in the widening of the half value width by about 0.4S. Accordingly, W can be shortened by 0.4S to be set at a half-integral multiple of S in the case of the modification when W is shorter than the multiple of S by about 0.1S. Thus, an opposite phase can also be used purposely for the rear edge.

Next, the case where the moving speed is slower (S≦W) and W is not close to an integral multiple of S (the case of NO in Step 105 of FIG. 2) will be described. In this case, W=(m+a)·S is assumed.

If modification waves are superposed as they are in such a state, then the rear edge side becomes a form such as a ghost image (a=¼) or the delay is enlarged (a=½) therein depending on the phase though no problem occurs on the front edge side. Accordingly, it is preferable that the phase of the modification wave be decided on the rear edge side independently of the front edge side. In this exemplary embodiment, if the modification waves for the front and rear edges are attenuated toward the center of the intermediate portion as shown in Step 108 of FIG. 2 and the amplitudes thereof are set at zero, then the modification waves for the front and rear edges can be decided separately from each other.

For example, if the modifications waves are attenuated in (1−x/nS), then the brightness on the front edge side is represented in the following equation 5. The brightness on the rear edge side is omitted since it becomes symmetric thereto.

$$V'(x)=V+a\cdot(1-x/nS)\cdot\sin(2\pi\cdot x/S) \qquad \text{Equation 5:}$$

This light-stimulus integration result in the blurred region width S as a blur on the front edge side is represented as in the following equation 6.

$$v(x)=V\cdot x/S+a/2\pi-a/2\pi\cdot\cos(2\pi\cdot x/S)+x/nS\cdot+a/2\pi\cdot\cos(2\pi\cdot x/S)+\tfrac{1}{2}n\pi\cdot a/2\pi\cdot\sin(2\pi\cdot x/S) \qquad \text{Equation 6:}$$

The intermediate portion is flat at the maximum brightness in the region width W−S, and is represented as in the following equation 7.

$$v(x)=V+1/n\cdot a/2\pi\cdot\cos(2\pi\cdot x/S) \qquad \text{Equation 7:}$$

If a=V, a surge of the brightness perceived at the intermediate portion to be flat becomes not less than 10% at n=3 and not less than 1% at n=30. Here, if a is reduced, then the surge is reduced though the effect thereof is lowered. With regard to the width W, m>2n is necessary, and the width W is conceived to be effective at about W>10S.

It is noted that, if the width W of the object is not sufficiently wider than the moving speed S, then the surge becomes remarkable, and therefore, the attenuation modification cannot be applied thereto.

Figure 4:
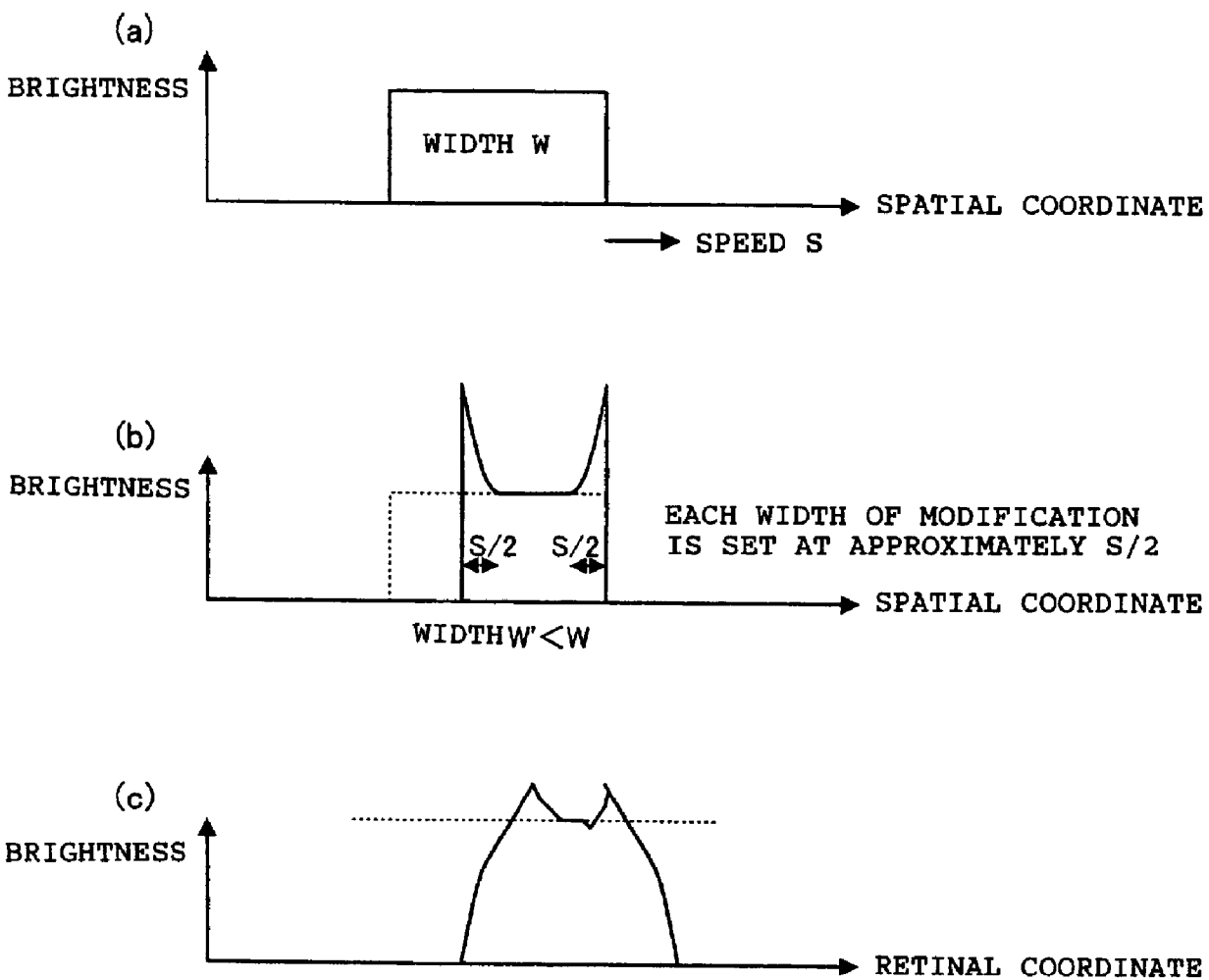
FIGS. 4(*a*) to 4(*c*) are diagrams for explaining a relief measure when an attenuation modification cannot be applied to the object.

FIGS. 4(*a*) to 4(*c*) are diagrams for explaining a relief measure when the attenuation modification cannot be applied, and describe Step 109 shown in FIG. 2.

FIG. 4(*a*) shows when an object with the width W moves on the image display unit 31 at a speed S. Here, for example, avoiding an under-modification on the background side, the width W is shortened to W' and brightness enhancement is applied to both sides of the object as shown in FIG. 4(*c*).

Thus, an effect to some extent can be exerted. In this case, brightness enhancement portions are generated in the perceived brightness, as shown in FIG. 4(*c*).

Here, if the both sides of the object are modified by the crests attenuating rapidly in the width of about S/2 as shown in FIG. 4(*b*), then the rising of the perceived brightness from the background brightness can be steepened and the maximum brightness of the over portion can be suppressed to be low as shown in FIG. 4(*c*).

Specifically, the half-value width is widened since the half-value point of the front edge advances and the half-value point of the rear edge retreats, and therefore, it is preferable to display the object with the width thereof being shortened for the amount of such widening.

Next, the case where the moving speed is faster (S>W) will be described. In this case, relief for that the half-value width becomes S and that the maximum brightness becomes V·W/S is difficult by any method other than the blanking method. Therefore, the means is varied depending on what to be relieved and what the restrictions are.

Figure 5:
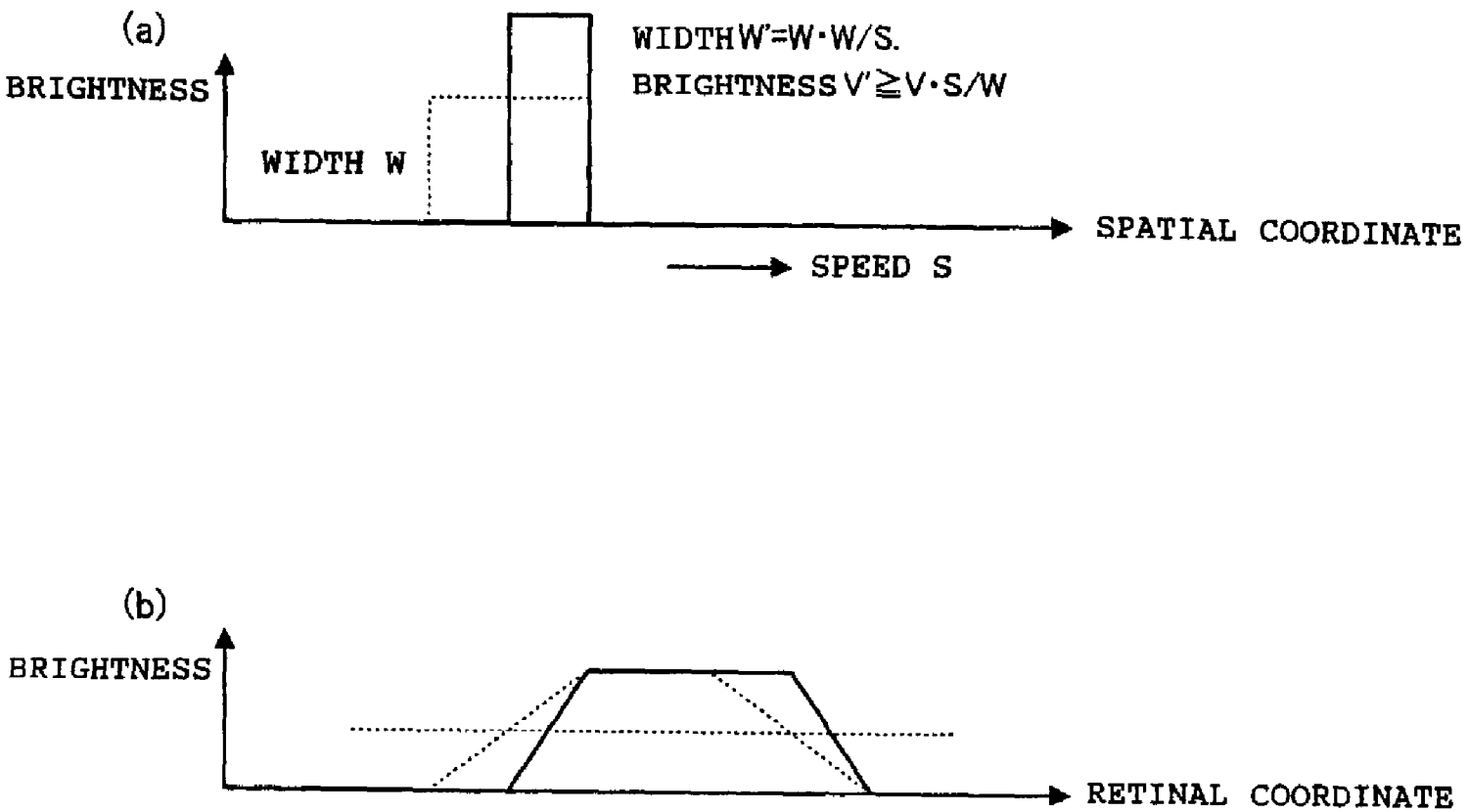
FIGS. 5(*a*) and 5(*b*) show when there is room in brightness of a motion object displayed on an image display unit.

FIGS. 5(*a*) and 5(*b*) show the case of Step 111 shown in FIG. 2 (i.e., when there is room in the brightness of the motion object displayed on the image display unit 31).

FIG. 5(*a*) shows that the width W of the pixel shown by the dashed line is shortened to the width W' by shortening the width of the stage though the half-value width S is left as it is, which is the width of the half-value portion with respect to the brightness of the motion object.

In such a manner, as shown in FIG. 5(*b*), the front and rear blurred regions shown by the dashed line can be thinned (reduced) as shown by the solid line.

Specifically, if the width W' to be displayed is reduced as W'=W·W/S and the brightness is enhanced as V'=V·S/W, then the maximum brightness to be perceived remains unchanged at V·W/S. However, the width of the stage is shortened to S+W'=S+W·W/S, and for the amount, the blurred region is reduced to be steepened, and the front edge, the center and the rear edge advance together. Naturally, if V' is increased more, then the maximum brightness is brought close to V.

Next, description will be made for the case where there is a little room in the brightness and the blur on the edges is desired to be steepened without changing the stage width when the moving speed is faster (S>W).

Figure 6:
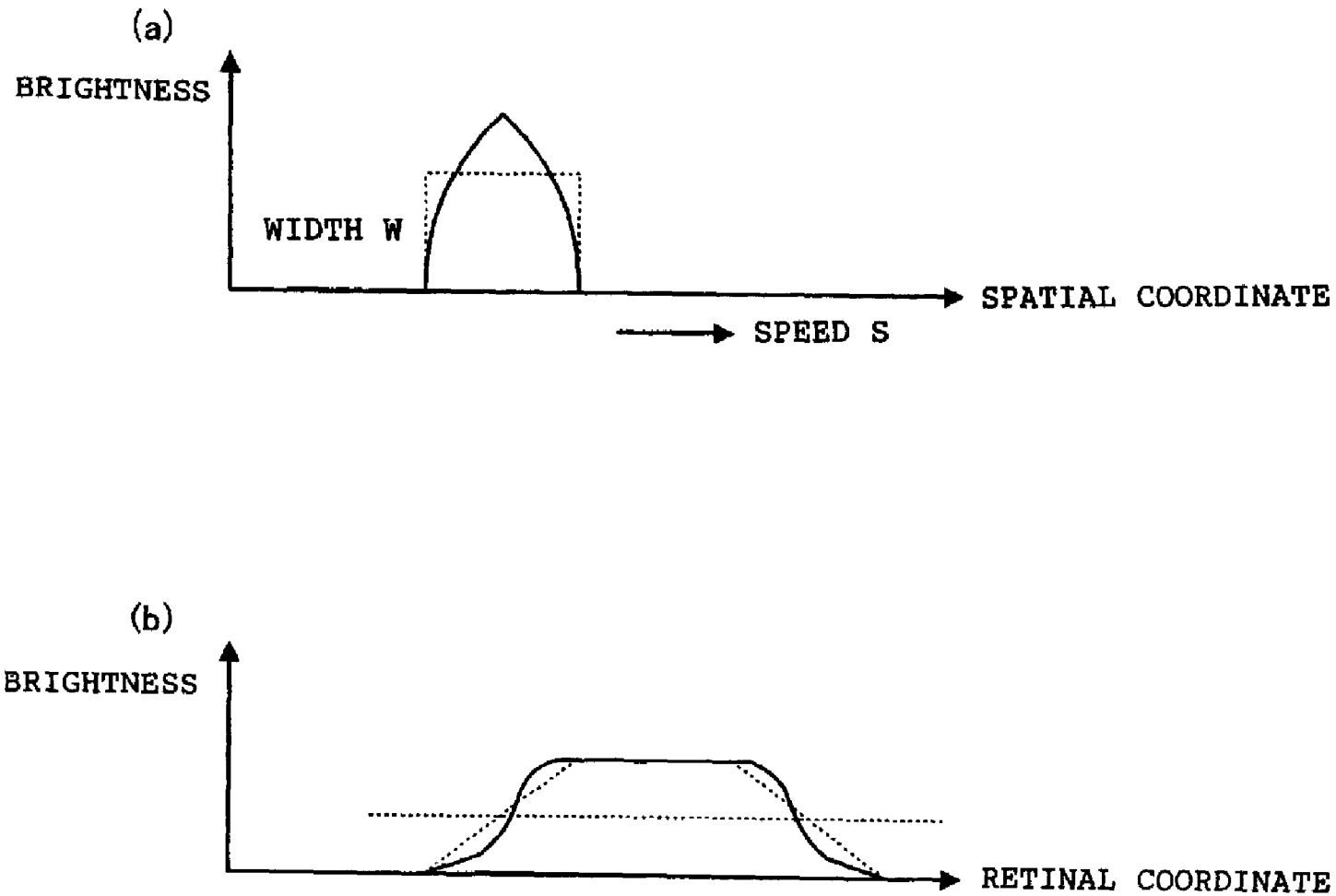
FIGS. 6(*a*) and 6(*b*) are diagrams for explaining a method for steepening blurred regions by changing a light emitting form even with the width of the object being unchanged.

FIGS. 6(*a*) and 6(*b*) are diagrams for explaining a method for steepening the blurred regions by changing a light emitting form with the width of the object being unchanged.

In FIG. 6(*a*), as described in Step 113 of FIG. 2, the brightness form of the display is made into a crest form, and thus the gradient at the half-value point is steepened. Specifically, the crest form is prepared in a possible range so as to give an edge as steep as possible in the range of room in the brightness.

As shown in FIG. 6(*b*), the brightness to be perceived expands on the effective flat portion. It is noted that this method can be utilized also for steepening the blur of the edges even if there is room in the brightness while the case has been described here as means for when there is no room in the brightness. If there is room in the brightness, then the blur of the edges can be further eliminated.

Next, it will be described when the half-value width is desired to be maintained though the width of the stage is allowed to be expanded, the gradient at the half-value point is desired to be steepened, and the brightness on the flat portion is desired to be increased to V when the moving speed is faster (S>W).

Figure 7:
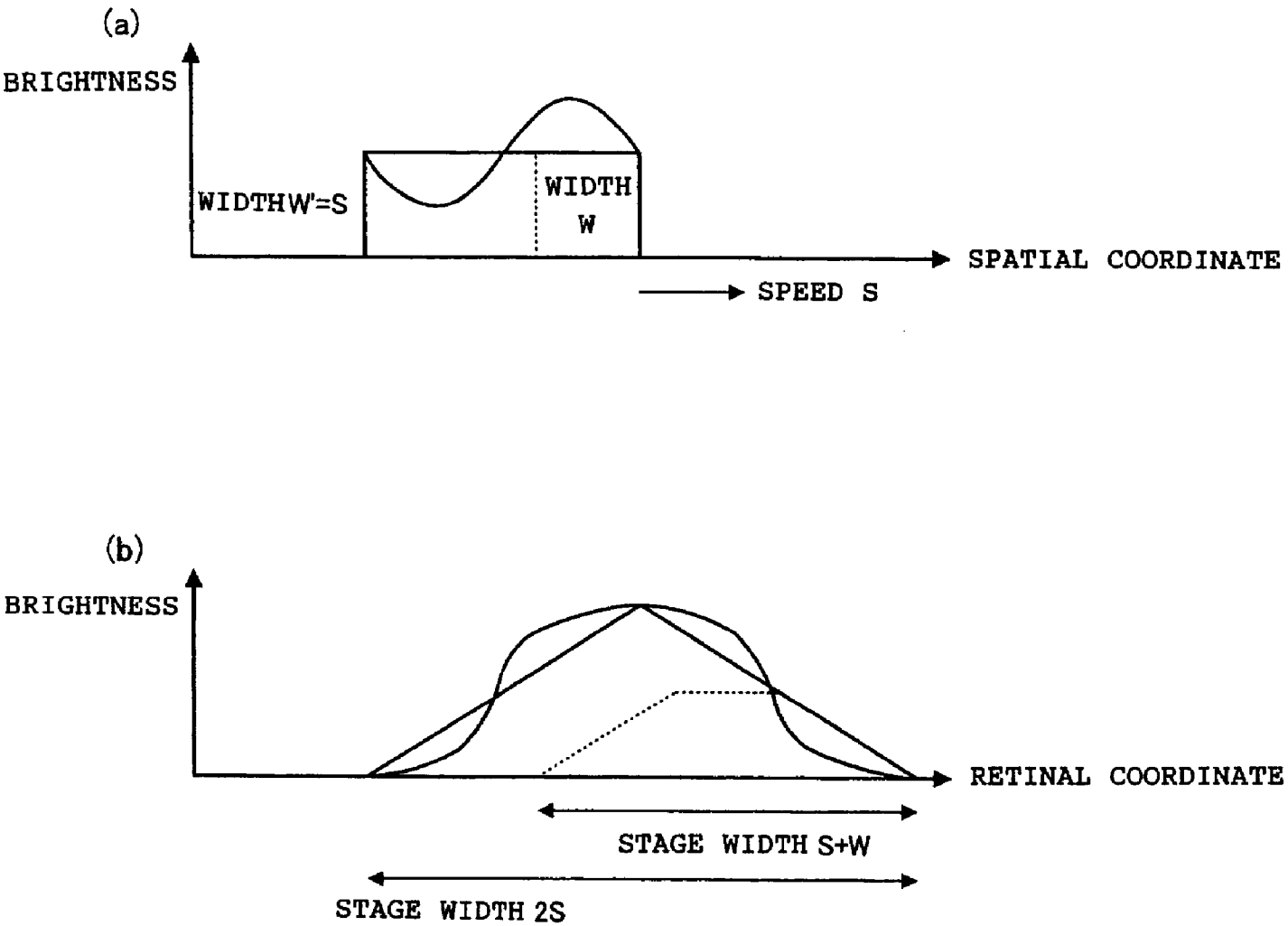
FIGS. 7(*a*) and 7(*b*) are diagrams for explaining a state where the width W of the object is extended to S and the object is modified by a sine wave with the wavelength S.

FIG. 7(*a*) and 7(*b*) are diagrams for explaining a state shown in Step 115 of FIG. 2, where the width of the object is extended to S and the object is modified by the sine wave with a wavelength S. It is believed that the reduction of the perceived brightness in the moving object is a great factor of deterioration of the contrast of the motion picture (i.e., deterioration of the quality of the motion picture). Therefore, this method is effective for the recovery of the brightness.

If the moving speed is faster (S>W), then the half-value width S is elongated to S. Therefore, the maximum brightness can reach V by displaying the object at the width W'=S.

However, the perceived brightness becomes triangular as in FIG. 7(*b*) if the object is solidly painted unchangedly with the brightness V. Therefore, it is preferable to add thereto the modification by the sine wave with the wavelength S. Then, the effective flat portion is also close to S with the half-value width S as it is, and a steep form is obtained at the half-value point though the width of the stage is expanded to 2S. Then, the positions of the front edge, center and rear edge will be delayed, and the display position is advanced beforehand in consideration of those amounts. The modification is limited by the brightness which the display can display in accordance with this method. Therefore, the ratio of the maximum brightness to "V" can be recovered to is determined.

Figure 8:
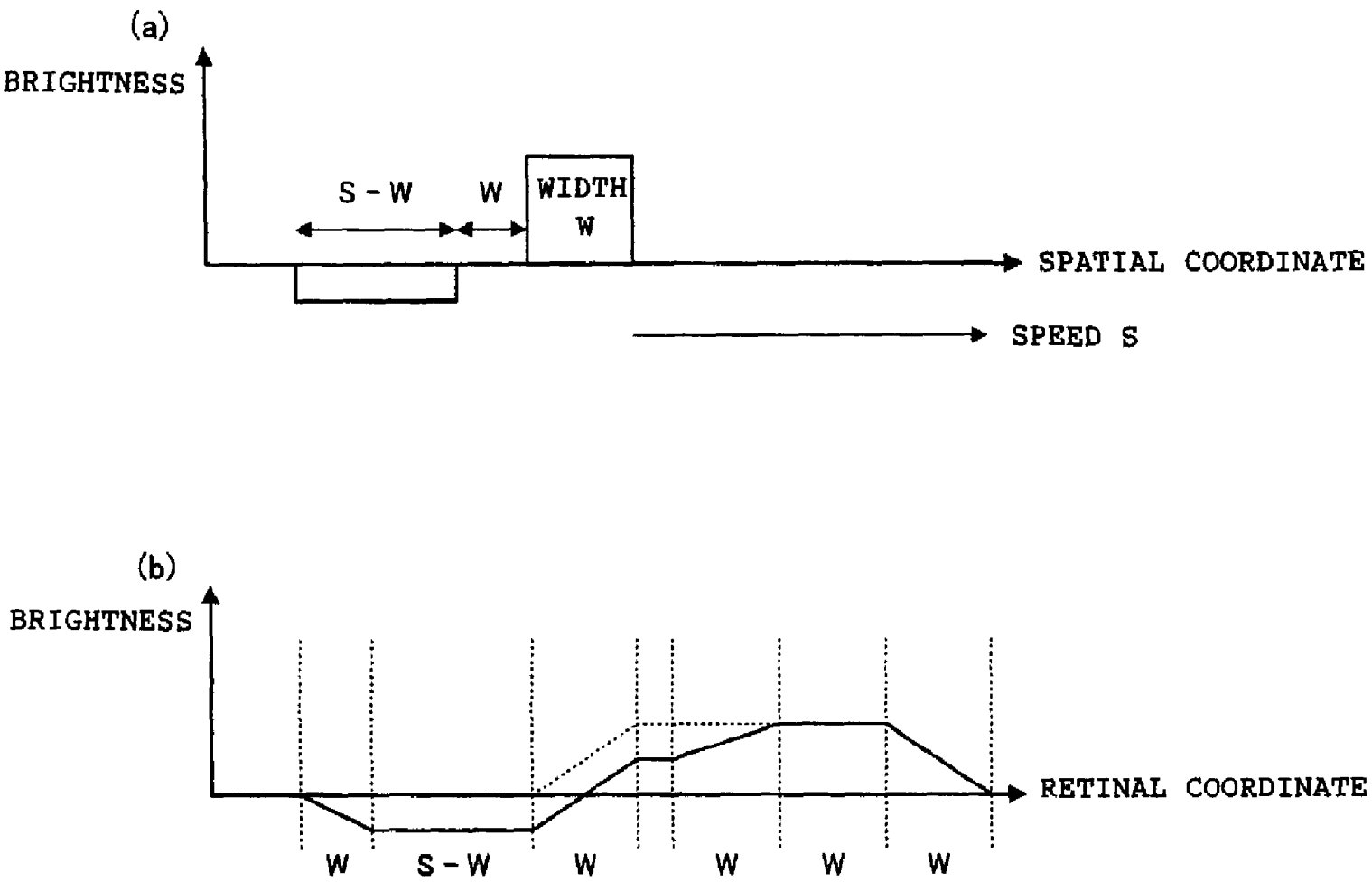
FIGS. 8(*a*) and 8(*b*) are diagrams showing an improved method for the moving object when brightness on a background can be lowered.
Figure 9:
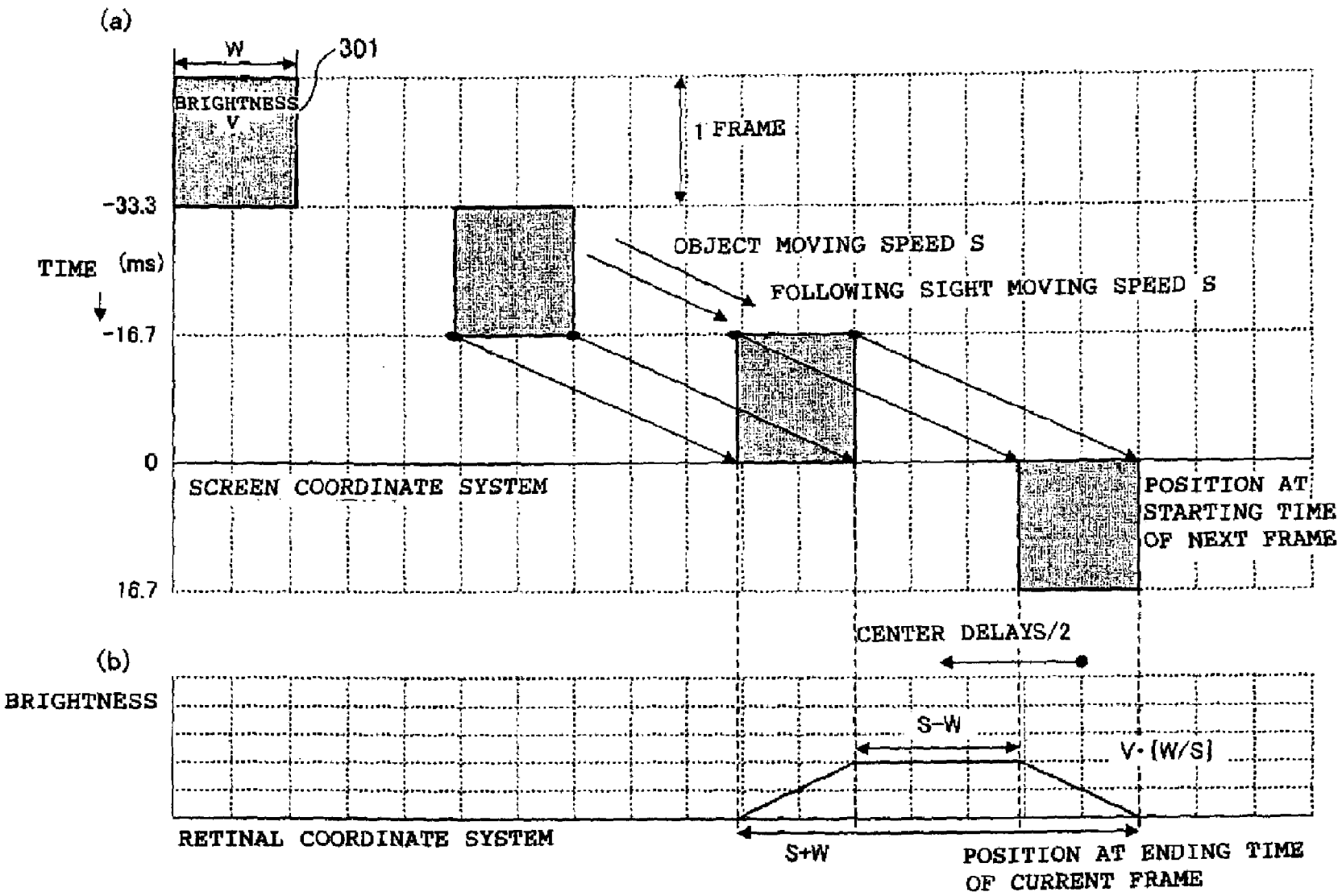
FIGS. 9(*a*) and 9(*b*) are diagrams for explaining a light-stimulus integration in a complete-hold-type display.

FIGS. 8(*a*) and 8(*b*) are diagrams showing an improved method for the moving object when the brightness on the background can be lowered. Here, this method can be utilized when the influence to the background is permitted, a shade is attached to the prolonged flat portion, and the center of gravity in the moving object is desired to be indicated.

As shown in FIG. 8(*a*), the brightness of the background at the rear of the object is made slightly lower than the average background level. In FIG. 8(*a*), the brightness is lower from the position delayed by W by the coordinate of S−W.

In this method, as shown in FIG. 8(*b*), though the maximum brightness of the object remains at V·W/S, where no improvement is seen, the brightness of the flat portion is reduced at a position entering from the front edge of the flat portion by W, where the object will be seen as if a stripe with a width W were inserted therein. Consequently, the position of the center or center of gravity approaches forward, and the delay of the position of the center (or center of gravity) can be solved. However, a shadow occurs as an adverse effect on the background at the rear of the object. It is noted that such an effect as described above cannot be generated by a usual edge emphasis.

As described above, in this exemplary embodiment, the blur of the front edge, the tailing of the rear edge, the lowering of the brightness, the delay of the perceived position at the front edge or the center position and the like, can be solved for the object in motion in a display. Such a display is capable of representing a gray scale without depending on a subfield among complete hold-type displays with a response time of zero such as the OLEDs and for an LCD, in which an absolute precision and a response speed are sufficiently high, such as, for example, a fast response type liquid crystal panel including an OCB type to which an overdrive is applied. In this case, the quality of the motion picture to be displayed can be brought close to the quality of the motion picture on the impulse-type display without depending on the blanking method.

Moreover, the compensation for the position delay can be applied not only to the complete hold-type display, but also to a display such as the LCD in which the response speed is slow.

Furthermore, "the overlay of the brightness modulations" in this exemplary embodiment has been described on the premise that the solidly painted object clearly separated from the plain background moves at a constant speed. However, also in a general case where these conditions are not established, it is possible to improve the quality of the motion picture display by applying the method in this exemplary embodiment thereto.

It is noted that the respective functions of the image display method realized according to this exemplary embodiment can be grasped as a program to be executed in the processing device 10 (e.g., a computer).

Such a program can be in a form of being installed in a computer when the computer is provided to a customer, as well as in a form of a recording medium storing a program for being executed by a computer to be computer-readable (e.g., media such as a floppy disk and a CD-ROM). Further, such a form of the program can be readable by a floppy disk drive, a CD-ROM reading device or the like, and the program is stored in a flash ROM or the like and executed.

Moreover, another form of the program, for example, may be provided through a network by a program transmission device. This program transmission device includes, for example, a memory storing the program, which is provided in a server on the host side, and program transmitting means for providing the program through the network.

As described above, according to the present invention, the quality of the motion picture can be improved on the so-called "hold-type" display.

While the invention has been described in terms of several exemplary embodiments, those skilled in the art will recognize that the invention can be practiced with modification within the spirit and scope of the appended claims.

Further, it is noted that, Applicant's intent is to encompass equivalents of all claim elements, even if amended later during prosecution.

What is claimed is:

1. A system for displaying an image, comprising:

image information inputting means for receiving image information;

motion object detecting means for detecting a motion object in the image information inputted to said image information inputting means;

recognizing means for recognizing a moving state in the motion object detected by said motion object detecting means;

modification information adding means for adding modification information to the image information for modifying the motion object detected by said motion object detecting means based on the moving state recognized by said recognizing means; and means for providing the image information added with the modification information, to a display device, wherein said recognizing means recognizes a moving speed S as a number of moving pixels of the motion object between consecutive frames, and said modification information adding means adds modification information including a wave with a wavelength S to the image information based on the moving speed S recognized by said recognizing means.

2. The system for displaying an image according to claim 1, wherein:

object transforming means for transforming the motion object detected by said motion object detecting means, wherein said modification information adding means adds the modification information to the image information in regard to the motion object transformed by said object transforming means.

3. The system for displaying an image according to claim 1, wherein the wave with the wavelength S, being added by said modification information adding means, comprises:

a sine wave with the wavelength S.

4. A system for displaying an image, comprising:

image information inputting means for receiving image information;

motion object detecting means for detecting a motion object in the image information inputted to said image information inputting means;

recognizing means for recognizing a moving state in the motion object detected by said motion object detecting means;

modification information adding means for adding modification information to the image information for modifying the motion object detected by said motion object detecting means based on the moving state recognized by said recognizing means; and means for providing the image information added with the modification information, to a display device, wherein said recognizing means recognizes a moving speed S of the motion object, and said modification information adding means changes the modification information added to the image information in accordance with a magnitude relationship between the moving speed S recognized by said recognizing means and a width W in a moving direction of the motion object.

5. The system for displaying an image according to claim 4, further comprising:

object transforming means for transforming the motion object detected by said motion object detecting means, wherein said modification information adding means adds the modification information to the image information in regard to the motion object transformed by said object transforming means.

6. A method for displaying an image in motion on a hold-type display device, comprising:

receiving image information to be displayed on the display device;

detecting a motion object in the received image information;

creating modification information modifying the detected motion object;

adding the created modification information to the image information in regard to the motion object;

outputting the image information added with the modification information; and recognizing movement information in regard to the detected motion object, wherein the creating of the modification information creates the modification information based on the recognized movement information, wherein the created modification information comprises a wave with a wavelength S when a moving speed of the motion object is S (S pixels per frame).

7. A method for displaying an image in motion on a hold-type display device, comprising:

receiving image information to be displayed on the display device;

recognizing a moving speed S as a number of moving pixels of the motion object between consecutive frames, the motion object existing in the received image information;

recognizing a width W as a number of pixels along a moving direction of the motion object; and adding modification information to the motion object based on the recognized moving speed S and width W.

8. The method for displaying an image according to claim 7, further comprising:

creating a transformed motion object by transforming the motion object, wherein the adding of the modification information adds the modification information to the transformed motion object created.

9. The method for displaying an image according to claim 8, wherein:

the creating of a transformed motion object creates the transformed motion object by expanding and contracting the width W to an integral multiple of the moving speed S when the width W has a predetermined closeness to the integral multiple of the moving speed S, and the adding of the modification information modifies the transformed motion object created by using modification information comprising a wave with a wavelength S.

10. The method for displaying an image according to claim 7, wherein the adding of the modification information adds modification information comprising a wave with a wavelength S when the width W is larger than the moving speed S.

11. The method for displaying an image according to claim 7, wherein:

the adding of the modification information modifies the motion object by using a wave with a wavelength S, and, the wave, in a predetermined degree, attenuating from both of front and rear edges of the motion object toward an inside thereof, when the width W is sufficiently larger than the moving speed S.

12. A program for allowing a computer for driving a hold-type display device to realize:

a function for detecting a motion object in received image information;

a function for creating modification information modifying the detected motion object;

a function for adding the created modification information to the image information in regard to the motion object;

a function for outputting the image information added with the modification information, to the display device; and a function for allowing the computer to recognize a moving speed of the motion object, wherein the created modification information comprises information depending on the recognized moving speed, wherein the recognized moving speed comprises a number of pixels S between consecutive frames, and the created modification information comprises a sine wave with a wavelength S.

13. A program for allowing a computer for driving a hold-type display device to realize:

a function for receiving image information to be displayed on the display device;

a function for recognizing a moving speed S as a number of moving pixels of a motion object between consecutive frames, the motion object existing in the received image information;

a function for recognizing a width W of an object as a number of pixels along a moving direction of the motion object; and a function for adding modification information to the motion object based on the recognized moving speed S and the width W.

14. The program according to claim 13, further comprising:

a function for creating a transformed motion object by transforming the motion object, wherein the function for adding modification information adds the modification information to the transformed motion object created.

15. The program according to claim 13, wherein the function for adding modification information expands and contracts the width W to a width adapted to an integral multiple of the moving speed S when the width W has a predetermined closeness to the integral multiple of the moving speed S, and modifies the motion object by using a wave with a wavelength S.

16. A system for displaying an image, comprising:

a motion object detector for detecting a motion object in image information inputted to said system;

a recognizing device for recognizing a moving state in the motion object detected by said motion object detector;

a modification information adder for adding modification information to the image information for modifying the motion object detected by said motion object detector based on the moving state recognized by said recognizing device; and a display device for displaying the image information having been added with the modification information by said modification information adder, wherein said recognizing device recognizes a moving speed S as a number of moving pixels of the motion object between consecutive frames, and said modification information adder adds modification information including a wave with a wavelength S to the image information based on the moving speed S recognized by said recognizing device.

17. The system of claim 16, further comprising:

an image information input device for receiving said image information inputted to said system.

18. The system of claim 17, further comprising:

an object transformer for transforming the motion object detected by said motion object detector, wherein said modification information adder adds the modification information to the image information in regard to the motion object transformed by said object transformer.

19. The system of claim 17, wherein the wave with the wavelength S, being added by said modification information adder, comprises:

a sine wave with the wavelength S.

20. A system for displaying an image, comprising:

a motion object detector for detecting a motion object in image information inputted to said system;

a recognizing device for recognizing a moving state in the motion object detected by said motion object detector;

a modification information adder for adding modification information to the image information for modifying the motion object detected by said motion object detector based on the moving state recognized by said recognizing device; and a display device for displaying the image information having been added with the modification information by said modification information adder, wherein said recognizing device recognizes a moving speed S of the motion object, and said modification information adder changes the modification information added to the image information in accordance with a magnitude relationship between the moving speed S recognized by said recognizing device and a width W in a moving direction of the motion object.

21. The system of claim 20, further comprising:

an object transformer for transforming the motion object detected by said motion object detector, wherein said modification information adder adds the modification information to the image information in regard to the motion object transformed by said object transformer.

* * * * *